United States Patent [19]
Verboom et al.
[11] Patent Number: 4,475,835
[45] Date of Patent: Oct. 9, 1984

[54] DEVICE FOR CLEANING SOIL FROM OVEN SURFACES

[75] Inventors: Gilles M. Verboom, Bolingbrook; Thomas L. Welsh, Downers Grove; Henry P. Furgal, Lombard, all of Ill.

[73] Assignee: Miles Laboratories, Inc., Elkhart, Ind.

[21] Appl. No.: 420,954

[22] Filed: Sep. 21, 1982

[51] Int. Cl.[3] ..... A47L 13/34; A46B 11/02
[52] U.S. Cl. ..... 401/132; 401/196
[58] Field of Search ..... 401/132, 196

[56] References Cited

U.S. PATENT DOCUMENTS 2,961,677 11/1960 Zecchini ..... 401/196 X
3,386,793 6/1968 Stanton ..... 401/132
3,466,131 9/1969 Arcudi ..... 401/132

FOREIGN PATENT DOCUMENTS 0042806 12/1981 European Pa. Off. ..... 401/196
77632 4/1960 France .

*Primary Examiner*—Steven A. Bratlie
*Attorney, Agent, or Firm*—Jerome L. Jeffers

[57] ABSTRACT

Disclosed is a device for applying a cleaning solution to a surface and for applying a scrubbing action to such surface. The device comprises a reservoir, a piercable closing means enclosing the reservoir to retain the cleaning solution therein and an abrasive scrubbing pad over the open mouth of the reservoir through which cleaning solution can be extruded onto the soiled surface and which can be used to provide a scrubbing action to the soil.

10 Claims, 4 Drawing Figures

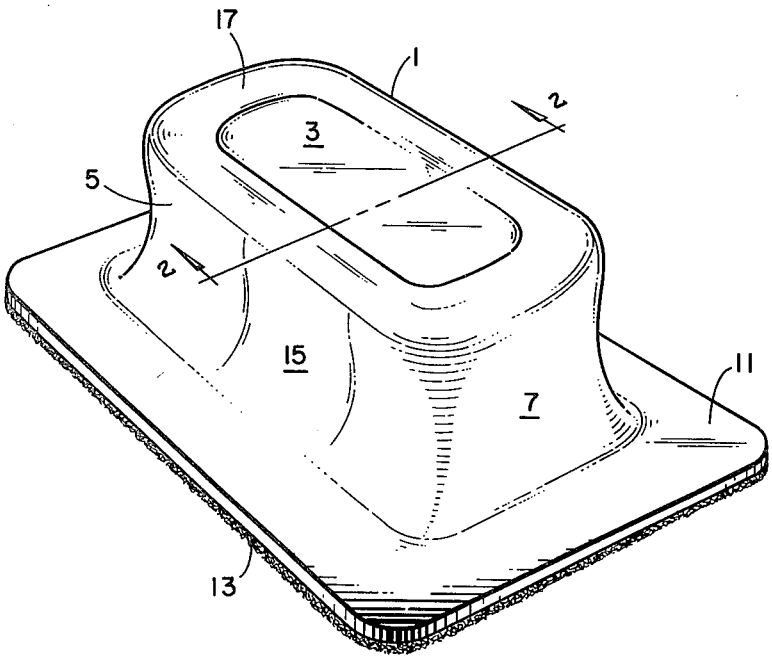
FIG. I
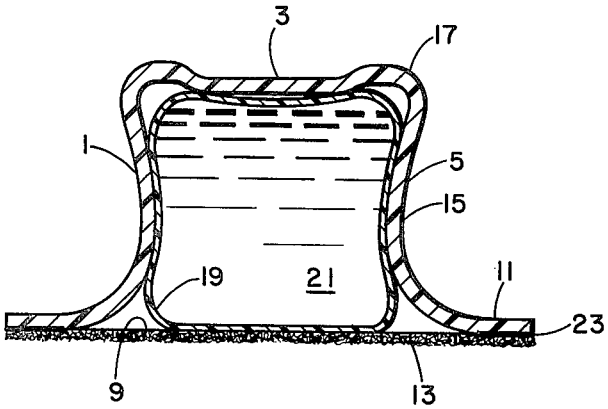
FIG. II

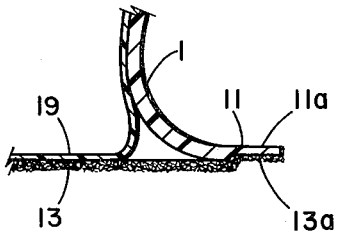
FIG. IIa
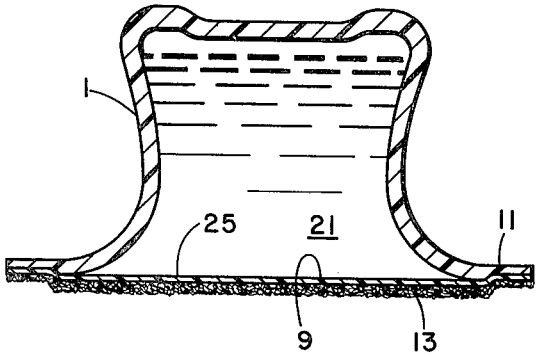
FIG. III

DEVICE FOR CLEANING SOIL FROM OVEN SURFACES

BACKGROUND OF THE INVENTION

This invention involves a device for the application of a cleaning solution to a soiled surface which device can also be used to apply a scrubbing action to help remove the soil. This device can, if desired, be used once and then discarded and, accordingly, can be considered as a member of the class of so-called "one-shot disposable applicators". Because of its unique ability to function as both an applicator and scrubber, the device of the present invention is particularly useful for the cleaning of soiled areas.

French Patent of Addition No. 77,632 discloses an applicator pad-polisher which includes a pocket or reservoir for a flowable material. The reservoir is frustum shaped with an annular flange around its open bottom and is constructed of a flexible plastic material to enhance its flexibility. A foam applicator material is positioned over the open bottom and held in place by use of a shouldered washer which is crimped onto the edge of the applicator and the flange which are superposed. Crimping the washer to hold the applicator in place necessarily results in the foamed material being compressed in a portion of its area which overlays the flange. Stanton, in U.S. Pat. No. 3,386,793, discloses a device whose primary point of demarcation with that of French Patent of Addition No. 77,632 seems to be in leaving the applicator pad in an uncompressed condition while attaching it to the flange such as by heat sealing or H. F. welding.

Neither of these devices disclosed in the prior art are particularly well-suited to the controlled application of a cleaning solution to a soiled surface such as the interior of an oven and the application of an abrasive scrubbing action to the soiled surface to enhance soil removal.

SUMMARY OF THE INVENTION

The present invention involves a device for applying a cleaning solution to soil on a soiled surface which is capable of simultaneously applying a scrubbing action to the soil. Referring to FIG. I, the device comprises a generally oblong reservoir 1 having a top 3, first and second elongated sidewalls 5 depending from the top and third and fourth endwalls 7 terminating in a common plane to form an open bottom to the reservoir. There is a lip 11 surrounding the open bottom formed by a coplanar extention of the sidewalls 5 and endwalls 7 extending transversely outwardly from the bottom a sufficient distance to permit the firm attachment thereto of an abrasive scrubbing pad 13. The top 3, sidewalls 5, endwalls 7 and lip 11 of the reservoir 1 are formed as a unitary structure from flexible polymeric sheet material. Each sidewall 5 contains an elongated indentation 15 therein which indentations extend in a direction parallel to the top 3 and are suitable for gripping between the user's thumb and fingers. These indentations also assist in providing the reservoir with compressibility when the sidewalls are squeezed inwardly toward each other. The top 3 has a crown-like ridge 17 around the perimeter thereof to provide rigidity thereto when the sidewalls are squeezed and the endwalls 7 have sufficient rigidity to support the top 3 without collapsing when scrubbing pressure is applied to the top in a direction normal to the soiled surface to be cleaned. The abrasive scrubbing pad 13 extends over the entire open bottom of the reservoir and is firmly attached to the lip 11 around its entire perimeter.

During pre-use storage, the cleaning solution is retained in the reservoir by a piercable closing means which is impermeable to the solution until pierced. Referring to FIG. II which depicts a lateral cross-section of the device depicted in FIG. I, there can be seen a piercable pouch 19 as the closing means located within the reservoir 1 which is capable of supplying cleaning solution 21 to the open bottom of the reservoir 9 upon being pierced. FIG. III depicts another embodiment where, instead of a piercable pouch, there is employed a piercable membrane 25 which is stretched across the open bottom 9 of the reservoir to operate as closing means.

BRIEF DESCRIPTION OF THE DRAWINGS

FIG. I is a perspective view of the oven cleaning applicator;

FIG. II is a cross-sectional view along line 2—2 of FIG. I;

FIG. II*a* is an enlarged section of an alternative lower connection; and

FIG. III is a cross-sectional view of a second embodiment of the invention.

DESCRIPTION OF THE INVENTION

The presently claimed invention provides a unique, one-piece, disposable product which comprises a cleaning solution reservoir and a working surface which is abrasive enough to enhance cleaning while the entire unit acts as an applicator-scrubber type tool. The design of this device promotes and enhances the inherent ability of the cleaning solution in removing food soil which has been baked onto oven surfaces. By using an appropriate caustic cleaning solution in combination with the abrasive pad as working surface, the device is made suitable for cleaning even cold oven surfaces and does not require preheating of the oven as is the case with spray-on oven cleaning products. Another advantage is that the user is not subjected to the disagreeable odors normally associated with spray-on cleaning products. In a preferred embodiment, the device can be designed to fit comfortably in the hand thereby enhancing its scrubbing features.

In operation, the device is activated by piercing the piercable closing means retaining the cleaning solution. This can be accomplished by placing piercing means inside the reservoir which would be situated to pierce the closing means upon squeezing the reservoir body. Alternatively, the closing means can be pierced by simply sticking a sharp object through the abrasive pad and into it to release cleaning solution. Once the closing means is pierced, the desired amount of cleaning solution can be extruded through it and the solution permeable abrasive pad and onto the soiled surface by simply squeezing the elongated indentations in the reservoir's side walls with the thumb and fingers. The crown-like ridge around the perimeter of the top of the reservoir prevents its total collapse upon being squeezed thereby permitting the application of a controlled amount of cleaning solution. While the device can be used in a "one shot" mode, because of its unique feature of permitting the controlled extrusion of cleaning solution, it is possible to store it for reuse when the particular job does not require expulsion of all the cleaning solution.

By providing rigid endwalls to the reservoir, a scrubbing action can be applied by exerting pressure with the hand in a plane normal to that of the surface being cleaned without collapsing the reservoir and thereby extruding more solution than is desired. The feature of applying a controlled amount of cleaning solution while retaining its rigidity in a plane normal to the surface being cleaned so that vigorous scrubbing can be applied is also a desirable attribute of a device of this type. This is the case because the hard, baked-on soil prevalent in dirty ovens is mostly porous. However, in many instances, the surface of the soil is covered with a polymer-like film which must be broken to expose the porous part of the soil. Because of the unique combination of the applicator and scrubber features in the device of this invention, the process of applying the cleaning solution with concomitant scrubbing inherently breaks the surface film so that the cleaning solution is delivered to the porous soil to achieve the most immediate and thereby efficient contact. Of course, the user could conceivably apply a cleaning solution and later scrub with a scrubbing material. However, instead of cleaning the oven in a one-step process as is possible with the device disclosed herein, the user is faced with a two-step process which would require twice the time. Furthermore, when scrubbing with a separate scrubber, the user would abraid the soiled surface but in the process would most likely spread the cleaning solution thinly over the area scrubbed and require another application of the cleaning solution. With the present device, the fluid is delivered as the user scrubs and, inherent in this process, the solution is intimately mixed with the soil.

The reservoir is a unitary structure constructed of flexible, polymeric sheet material. Suitable construction materials include a cross-linked polyethylene foam or such polymers as polyethylene, polypropylene, a polyester or polyvinyl chloride. The unitary reservoir can be conveniently formed by blow molding, vacuum molding or heat forming techniques. The mold is designed to provide a reservoir which will comfortably fit in the user's hand, and with this consideration in mind, a length of about $3\frac{1}{2}$ to $4\frac{1}{2}$ inches, a width of about $1\frac{1}{2}$ to $2\frac{1}{2}$ inches and a height of about $1\frac{1}{2}$ to $2\frac{1}{2}$ inches are preferred. The compressibility of the reservoir, in its areas where compressibility is desired, and its rigidity, in areas where rigidity is desired, will, of course, vary depending on the particular material selected for its construction and its thickness. Regardless of the construction material and its thickness, the design of the present device allows one to provide a combination applicator/scrubber which is flexible enough for controlled application of the cleaning solution yet rigid enough to be an efficient scrubber. The elongated indentations which enhance the flexibility of the sidewalls may extend along the entire length of the sidewalls but need not necessarily do so provided they are of sufficient length to enhance the flexibility of the reservoir. The thickness and configuration of the endwalls are not critical provided they are of sufficient rigidity to resist collapsing under scrubbing pressure. The crown-like ridge can be, in reality, a thickened portion of the reservoir around the perimeter of the reservoir top and prevents it from collapsing while the sidewalls are being squeezed to extrude cleaning solution. The width of the lip is not critical providing its provides sufficient surface for the firm attachment of the abrasive scrubbing pad. A wider lip than is absolutely necessary for such attachment may be desirable to protect the user's fingers from contact with the cleaning solution during use.

The piercable closing means can be made of any material which is non-reactive with the cleaning solution, forms a solution tight seal and can be pierced when desired to release the solution. Suitable materials include those which are well-known in the packaging industry. Films of polyethylene, nylon, polyvinyl chloride or a polyester sandwiched between nylon and/or polyethylene are suitable.

The cleaning solution is typically caustic based and will contain as its basic elements sodium hydroxide, water, a surfactant and a viscosity controller to provide a viscosity of 200 to 2,000 centipoise at room temperature.

The abrasive scrubber is attached to the reservoir lip around its entire perimeter. The construction material for the scrubber is not critical provided it provides the desired abrasiveness and is, of course, permeable to the cleaning solution so it can be extruded onto the soiled surface during use. The known versatility of manufacture and use of non-woven scrubber pads made with synthetic fibers sprayed with abrasive, makes this category of scrubber highly suitable for this application. The scrubber thickness and fiber density can be adjusted to optimize its applicator function while the abrasiveness is adjustable for soft, medium or heavy duty cleaning. Preferably, the scrubber pad is a non-woven screen of nylon or polyester fibers formed with an adhesive agent to bind them together. A scouring agent can be added to increase its abrasiveness. Adherence of the scrubber to the reservoir lip can be accomplished by the use of commercially available adhesives indicated as 23 in FIG. II. Alternatively, when the reservoir is constructed of a thermoplastic resin, the scrubber can be attached by a hot melt process whereby heat and pressure are applied to the area of attachment as illustrated by FIG. II*a*. This results in the portion of the scrubber 13*a* being permanently compressed in its area of attachment to the lip, but such compression has little if any effect on the functionality of the device. When the lip is constructed of a foamed polymeric material, it will normally undergo some compression during the hot melt process as is depicted by 11*a* in FIG. II*a*.

What is claimed is:

1. A device for applying a caustic containing cleaning solution to soil on a soiled oven surface and which is capable of simultaneously applying a scrubbing action to the soil, which device comprises a reservoir, a piercable closing means capable of keeping the cleaning solution in the reservoir until it is pierced and an abrasive, cleaning solution permeable, scrubbing pad of a non-woven screen of fibers formed with an adhesive to bind them together, the reservoir being generally oblong having a top, first and second elongated sidewalls depending from the top, third and fourth endwalls depending from the top, the sidewalls and endwalls terminating in a common plane to form an open bottom to the reservoir, and a lip surrounding the open bottom formed by a coplanar extension of the sidewalls and endwalls extending transversely outwardly from the open bottom a sufficient distance to permit the firm attachment of the abrasive scrubbing pad thereto, the top, sidewalls, endwalls and lip being formed as a unitary structure from a flexible polymeric sheet material and where the reservoir is of a size which will fit comfortably in a user's hand such that the sidewalls are from about $3\frac{1}{2}$ to $4\frac{1}{2}$ inches long, the endwalls are about $1\frac{1}{2}$ to 2½ inches long and the reservoir had a depth of about 1½ to 2½ inches, the sidewalls each having an elongated indentation therein extending parallel to the top and suitable for gripping between the user's thumb and fingers and which assist in providing the reservoir with compressibility when the sidewalls are squeezed inwardly towards each other, the top having a crown-like ridge around the perimeter thereof to provide rigidity thereto when the sidewalls are squeezed, the endwalls being of sufficient rigidity to support the top without collapsing when scrubbing pressure is applied to the top in a direction normal to the surface being cleaned; the piercable closing means being positioned so as to be capable of supplying cleaning solution to the open bottom of the reservoir upon being pierced; the abrasive scrubbing pad extending over the entire open bottom of the reservoir and being firmly attached to the lip thereof around its entire perimeter.

2. The device of claim 1 wherein the closing means comprises a piercable pouch located within the reservoir.

3. The device of claim 1 wherein the closing means comprises a piercable membrane stretched across the open bottom of the reservoir.

4. The device of claim 1 wherein the polymeric material is selected from the group consisting of polyethylene, polypropylene, a polyester and polyvinyl chloride.

5. The device of claim 1 wherein the polymeric material is cross-linked polyethylene foam.

6. The device of claim 1 wherein the closing means is formed from a film selected from the group consisting of polyethylene, nylon, polyvinyl chloride and a polyester sandwiched between nylon and/or polyethylene.

7. The device of claim 1 wherein the cleaning solution is caustic based.

8. The device of claim 7 wherein the cleaning solution comprises NaOH, water, a surfactant and a viscosity controller to provide it with a viscosity of 200 to 2,000 centipoise at room temperature.

9. The device of claim 1 wherein the scrubbing pad is of a non-woven screen of nylon or polyester fibers formed with an adhesive agent to bind them together.

10. The device of claim 9 wherein a scouring agent is added to the non-woven screen.

* * * * *